US005408945A

United States Patent [19]

Bohlin

[11] Patent Number: 5,408,945

[45] Date of Patent: Apr. 25, 1995

[54] CABLE STEERING DEVICE, ESPECIALLY FOR BOATS

[75] Inventor: Stig Bohlin, Göteborg, Sweden

[73] Assignee: AB Volvo Penta, Goteborg, Sweden

[21] Appl. No.: 137,004

[22] PCT Filed: Apr. 24, 1992

[86] PCT No.: PCT/SE92/00272

§ 371 Date: Oct. 14, 1993

§ 102(e) Date: Oct. 14, 1993

[87] PCT Pub. No.: WO92/19494

PCT Pub. Date: Nov. 12, 1992

[51] Int. Cl.[6] ..... B63H 25/00

[52] U.S. Cl. ..... 114/144 R; 440/62

[58] Field of Search ..... 114/144 R, 150; 440/53, 440/60, 61, 62; 74/480 B, 502.4, 507

[56] References Cited

U.S. PATENT DOCUMENTS 3,050,025 8/1962 Atkeson .

4,237,656 12/1980 Hess et al. ..... 74/502.4

*Primary Examiner*—Jesu D. Sotelo

*Attorney, Agent, or Firm*—Young & Thompson

[57] ABSTRACT

Cable steering device, especially for boats, with an operating cable (3, 4) extending between a steering wheel mechanism (1, 2) and a steering mechanism (8, 10). The operating cable consists of a flexible sheath (3) and a flexible operating core (4) displaceable in the sheath. The cable has a pair of 90° curved portions (20, 22) which are fixed in individual load removing elements (24) in the form of a rigid rail with a U-profile.

4 Claims, 1 Drawing Sheet

CABLE STEERING DEVICE, ESPECIALLY FOR BOATS

Figures 1, 2:
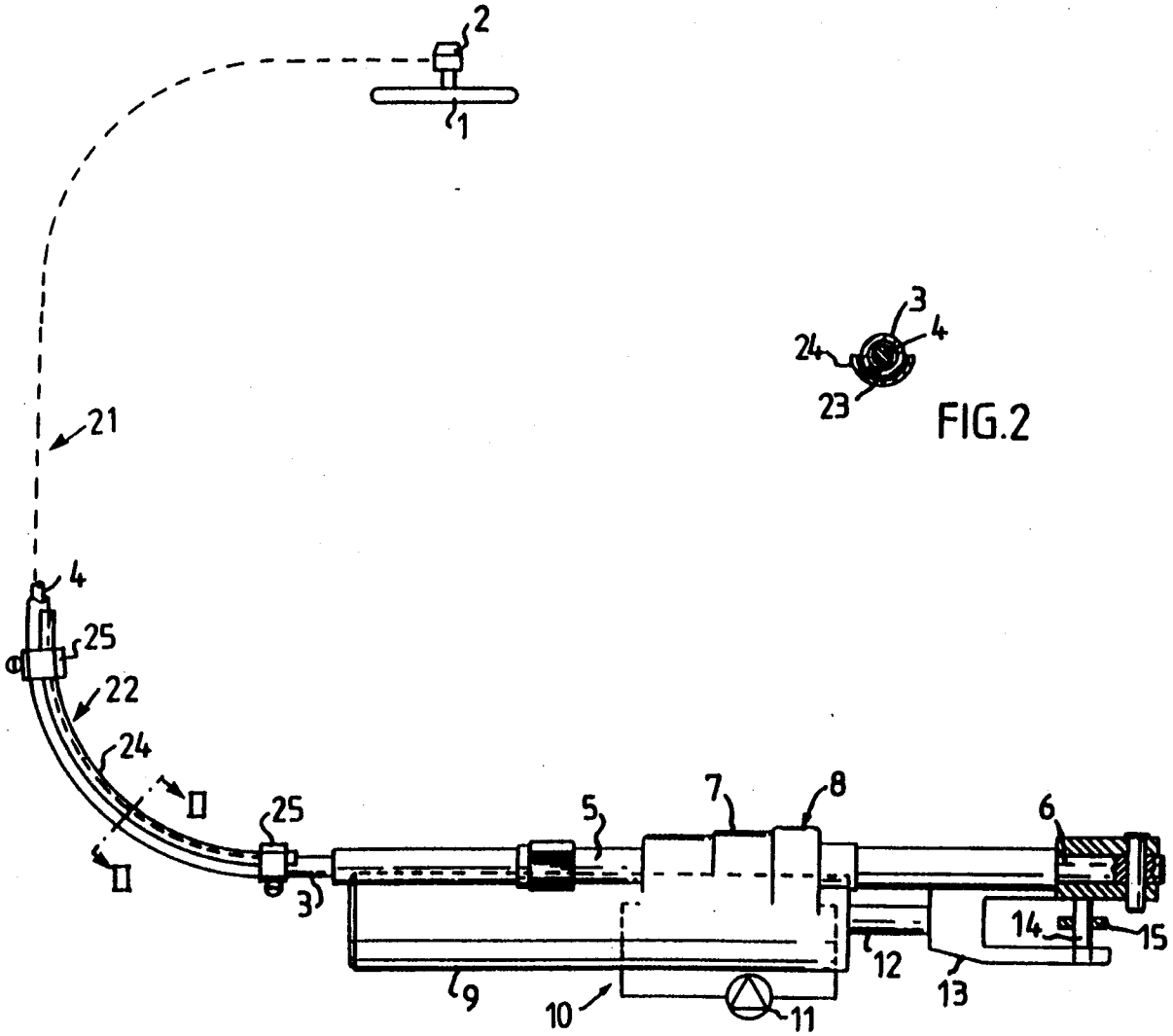

The present invention relates to a steering device comprising a steering cable, connected between a steering-wheel mechanism and a steering mechanism, and consisting of a flexible sheath and a flexible operating core displaceble in the sheath, said steering cable being arcuately curved over at least a portion thereof.

Steering devices of this type with so called push-pull cable have cables which normally extend from the steering wheel out to the side of the hull and then aft along the hull to a point just forward of the transom where the cable is curved about 90° in an arc towards the boat steering mechanism, which for example can comprise a steering arm on a rudder shaft or a steerable outboard drive unit. Especially in boats with double engines with outboard drive units, problems can rise in steering due to the small amount of space available athwartships (i.e. transversely to the boat) between the hull and the steering arm. The smaller the space available, the less will be the radius of curvature of the cable and the more the cable will strive by its resilience to press against the servo steering tube or sleeve, which is limitedly displaceable relative to a servo valve which is in turn controlled by the reactive force from the cable sheath created by the operating movement.

The problem with variation in the radius of curvature of the cable can be solved in a known manner by forming the curved portions of the sheath as rigid tubes. One disadvantage of such an arrangement is however that the steering cable sheath must be specially manufactured for each type of installation.

The purpose of the present invention is to provide a steering device of the type described by way of introduction which eliminates the above mentioned problem of small radius of curvature of the steering cable without the need to have the steering cable specially made for the installation in question. This is achieved according to the invention by virtue of the fact that the arcuate portion of the cable sheath is fixed to a rigid load removing element adapted to the curvature of the sheath and which has an open trough adapted to the cross section of the cable sheath to hold the same.

Such a steering device can be easily adapted to the installation in question by virtue of the fact that the cable can be laid into the trough from the side and fixed to the load removing element by a pair of ordinary tube or hose clips for example. This is significantly more simple than replacing the curved portions of the flexible sheath with rigid portions.

The invention will be described in more detail with reference to an example shown in the accompanying drawing, where FIG. 1 shows a schematic view of a servo assisted steering device with a load removing element according to the invention and FIG. 2 a cross section along the line II—II in FIG. 1.

In the Figure, 1 designates a boat steering-wheel which is connected to a transmission device 2, which, upon turning the wheel provides a displacement of a flexible cable core 4 in a flexible cable sheath 3. The device can be of any suitable type known per se as can be sheath 3 and the cable core 4 forming a so called push-pull cable common to boat steering mechanisms.

The cable sheath 3 is screwed securely to the end of a valve tube 5, which forms a guide for an operating rod 6 joined to the cable core 4. The valve tube 5 extends through a valve housing 7 to a servo valve with the general designation 8. The valve housing 7 is made in one piece with a hydraulic cylinder 9 of a double acting piston-cylinder device 10. The valve tube 5 is limitedly displaceable in the valve housing 7 and cooperates with a valve slide (not shown), which control the supply of hydraulic fluid to one or the other cylinder chamber in the cylinder 9 from a motor driven hydraulic pump 11 depending on the position of the valve tube relative to the valve housing. The servo valve 8, the valve tube 5 and the piston-cylinder device are units known per se.

The operating rod 6 and the piston rod 12 of the piston-cylinder device 10 are joined to a common connecting piece 13, which has a pin 14 held in a bore in a steering arm 15 on for example the steering shaft of an outboard drive unit. When the steering wheel 1 is turned so that the operating rod 6 is displaced outboards, i.e. to the right in FIG. 1, the valve tube 5 is displaced to the left relative to the valve housing under influence of the reactive force. The servo valve 8 will thus open and conduct hydraulic fluid into the left hand cylinder chamber of the cylinder 9 thus displacing the piston rod 12 to the right. As long as the steering wheel is turned with accompanying loading of the operating rod 6, the reactive force on the valve tube will cause hydraulic fluid to be supplied to a cylinder serving as a servo unit. When the turning of the steering wheel ceases, the servo valve 8 will close under the influence of a return flow between the operating rod 6 and the piston-cylinder device.

As can be seen in FIG. 1, the operating cable 3, 4 extends from the transmission device 2 via a 90° arch 22 to the valve tube 5 of the servo unit. The arcuate section 22 is placed in a trough in a rail 24 which extends along the curved portion of the steering cable.

The cable sheath 3 can be fixed for example to the rail 24 by means of a pair of hose clips 25 as can be seen in FIG. 1. The rail 24 is made of a rigid material, i.e. metal and is adapted to the cross sectional profile of the sheath in the example shown with a circular cross sectional profile of the sheath, the trough 23 has a U-shape (semicircular) cross section.

By virtue of the design shown and described here, the sheathed portion of the operating cable preserves its shape even when there is a very small radius curvature regardless of whether the operating movement is pushing or pulling, and this means that there will be no initial loads affecting the servo valve.

I claim:

1. In a steering device, comprising a steering cable, connected between a steering-wheel mechanism and a steering mechanism, and consisting of a flexible sheath and a flexible operating core displaceable in the sheath, said steering cable being arcuately curved over at least a portion thereof, the arcuate portion (20, 22) of the cable sheath (3) being fixed to a rigid load removing element (24) adapted to the curvature of the sheath and which has an open trough (23) adapted to the cross section of the cable sheath to hold the same; the improvement wherein the load removing element (23) is formed by a rail with a U-shaped cross sectional profile.

2. Steering device according to claim 1, wherein the load removing element (23) extends in an arc of approximately 90°.

3. Steering device according to claim 1, wherein the load removing element (23) is fixed on the inside of the curved portion of the sheath (3).

4. Steering device according to claim 1, further comprising a steering cable (3,4) connected to a servo unit (8,10), said steering cable extending in a primary direction from the steering mechanism and curving approximately 90° from the primary direction in an arc (22) immediately prior to the servo unit, wherein the load removing element (24) is fixed at the arcuate portion immediately prior to the servo unit.

* * * * *